US009368298B2

(12) United States Patent
Kikuchi

(10) Patent No.: US 9,368,298 B2
(45) Date of Patent: Jun. 14, 2016

(54) SWITCH AND MANUFACTURING METHOD OF SWITCH

(71) Applicant: Hidetake Kikuchi, Tama (JP)

(72) Inventor: Hidetake Kikuchi, Tama (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 295 days.

(21) Appl. No.: 14/045,104

(22) Filed: Oct. 3, 2013

(65) Prior Publication Data

US 2014/0097073 A1 Apr. 10, 2014

(30) Foreign Application Priority Data

Oct. 4, 2012 (JP) ..... 2012-222276

(51) Int. Cl.
*H01H 13/14* (2006.01)
*H01H 11/00* (2006.01)

(52) U.S. Cl.
CPC ..... *H01H 13/14* (2013.01); *H01H 11/00* (2013.01); *H01H 2215/018* (2013.01); *H01H 2215/02* (2013.01); *H01H 2223/002* (2013.01); *H01H 2229/008* (2013.01); *Y10T 29/49105* (2015.01)

(58) Field of Classification Search
CPC . H01H 13/14; H01H 11/00; H01H 2215/018; H01H 2215/02; H01H 2223/002; H01H 2229/008
USPC ..... 200/512, 406, 520, 5 A, 517, 341
See application file for complete search history.

(56) References Cited

U.S. PATENT DOCUMENTS 6,610,950 B1 * 8/2003 Kamio ..... H01H 13/48 200/406
7,740,166 B2 * 6/2010 Takeuchi ..... H01H 13/48 200/406
7,906,739 B2 * 3/2011 Villain ..... H05K 3/303 200/292
8,263,889 B2 * 9/2012 Takahashi ..... A63F 13/06 200/512
8,729,413 B2 * 5/2014 Nakaoka ..... H01H 13/705 200/512
2003/0213686 A1 * 11/2003 Takeuchi ..... H01H 13/20 200/406

FOREIGN PATENT DOCUMENTS

JP 2009123655 A 6/2009

* cited by examiner

*Primary Examiner* — Edwin A. Leon
(74) *Attorney, Agent, or Firm* — Witham, Curtis & Cook, P.C.

(57) ABSTRACT

A switch includes a case, fixed electrodes, a movable electrode and a pressing member. The fixed electrodes and the movable electrode are arranged inside the recess. The pressing member is arranged so as to cover at least a part of the recess, and displaces the movable electrode from the second position to the first position by a pressing force from the outside. The pressing member includes a first bent part and a second bent part, and a deforming part disposed therebetween. The deforming part is opposed to the movable electrode with a gap in a state where the movable electrode is in the second position. The deforming part is configured to be flexibly deformed toward the outside of the case in a state where the movable electrode is in the first position in which the fixed electrodes are in a conductive state.

8 Claims, 7 Drawing Sheets

SWITCH AND MANUFACTURING METHOD OF SWITCH

BACKGROUND

The present invention relates to a switch used in various small electronic devices, and particularly to a push switch mounted on a circuit board. Also, the invention relates to a manufacturing method of the switch.

In this kind of apparatus, plural fixed electrodes and a movable electrode are arranged on a circuit board. The movable electrode can be elastically displaced between a first position in which the plural mutual fixed electrodes are in a conductive state and a second position in which the plural mutual fixed electrodes are in a non-conductive state, and a pressing member is arranged as opposed to the movable electrode in the second position at neutral state. When the pressing member displaces the movable electrode to the first position by a pressing force from the outside, the mutual fixed electrodes are changed to the conductive state. When the pressing force is released, the movable electrode elastically returns to the second position and the mutual fixed electrodes are changed to the non-conductive state (for example, see Patent Reference 1).

[Patent Reference 1] JP-A-2009-123655

SUMMARY

It is therefore one advantageous aspect of the present invention to provide a technique capable of obtaining a desired switch operational feeling even in the case of increasing hermeticity of space for storage of a movable electrode and a fixed electrode.

According to one aspect of the invention, there is provided a switch comprising:

a case, configured to be mounted on a circuit board, and including a recess;

a plurality of fixed electrodes arranged inside the recess;

a movable electrode, arranged inside the recess, and configured to be displaced between a first position in which the fixed electrodes are in a conductive state and a second position in which the fixed electrodes are in a non-conductive state; and a pressing member, arranged so as to cover at least a part of the recess, and configured to displace the movable electrode from the second position to the first position by a pressing force from the outside, wherein the pressing member includes a first bent part and a second bent part, and a deforming part disposed between the first bent part and the second bent part, the deforming part is opposed to the movable electrode with a gap in a state where the movable electrode is in the second position, and the deforming part is configured to be flexibly deformed toward the outside of the case in a state where the movable electrode is in the first position.

The deforming part may be curved toward the outside of the case in the state where the movable electrode is in the first position.

The deforming part may be curved toward the recess in the state where the movable electrode is in the second position.

According to another aspect of the invention, there is provided a switch comprising:

a circuit board;

a plurality of fixed electrodes arranged on the circuit board;

a movable electrode, configured to be displaced between a first position in which the fixed electrodes are in a conductive state and a second position in which the fixed electrodes are in a non-conductive state; and a pressing member, arranged on the circuit board, covering the fixed electrodes and the movable electrode, and configured to displace the movable electrode from the second position to the first position by a pressing force from the outside, wherein the pressing member includes a first bent part and a second bent part, and a deforming part disposed between the first bent part and the second bent part, the deforming part is opposed to the movable electrode with a gap in a state where the movable electrode is in the second position, and the deforming part is configured to be flexibly deformed in a direction away from the circuit board in a state where the movable electrode is in the first position.

The deforming part may be curved in the direction away from the circuit board in the state where the movable electrode is in the first position.

The deforming part may be curved toward the circuit board in the state where the movable electrode is in the second position.

According to another aspect of the invention, there is provided a manufacturing method of a switch, comprising:

holding a resin molded body by a plurality of dies;

pressing the resin molded body from a first side thereof using a punch to form a plastic deformed part projecting to a second side opposite to the first side;

deforming the plastic deformed part so as to project to the first side to form a first bent part and a second bent part; and arranging a part of the resin molded body disposed between the first bent part and the second bent part so as to be opposed to a movable electrode of the switch with a gap.

The resin molded body may be formed of a material containing a thermosetting resin or a thermoplastic resin.

BRIEF DESCRIPTION OF DRAWINGS

FIG. 2A is a top view, FIG. 2B is a front view, FIG. 2C is a bottom view, FIG. 2D is a rear view, and FIG. 2E is a right side view.

DETAILED DESCRIPTION OF EXEMPLIFIED EMBODIMENTS

It is necessary to increase hermeticity of space for storage of the movable electrode and the fixed electrodes based on requests for waterproofness and dustproofness. In this case, when the pressing force is depressed and the movable electrode is displaced toward the fixed electrode, the air present in the space is resistant to being deflated (or cannot be deflated), and acts as resistance to displacement of the pressing force. As a result, a desired switch operational feeling cannot be obtained.

It is therefore one advantageous aspect of the present invention to provide a technique capable of obtaining a desired switch operational feeling even in the case of increasing hermeticity of space for storage of a movable electrode and a fixed electrode.

Embodiments of the invention will hereinafter be described in detail with reference to the accompanying drawings. In addition, in each of the drawings used in the following description, a scale is properly changed in order to obtain the size capable of recognizing each member.

Figure 1:
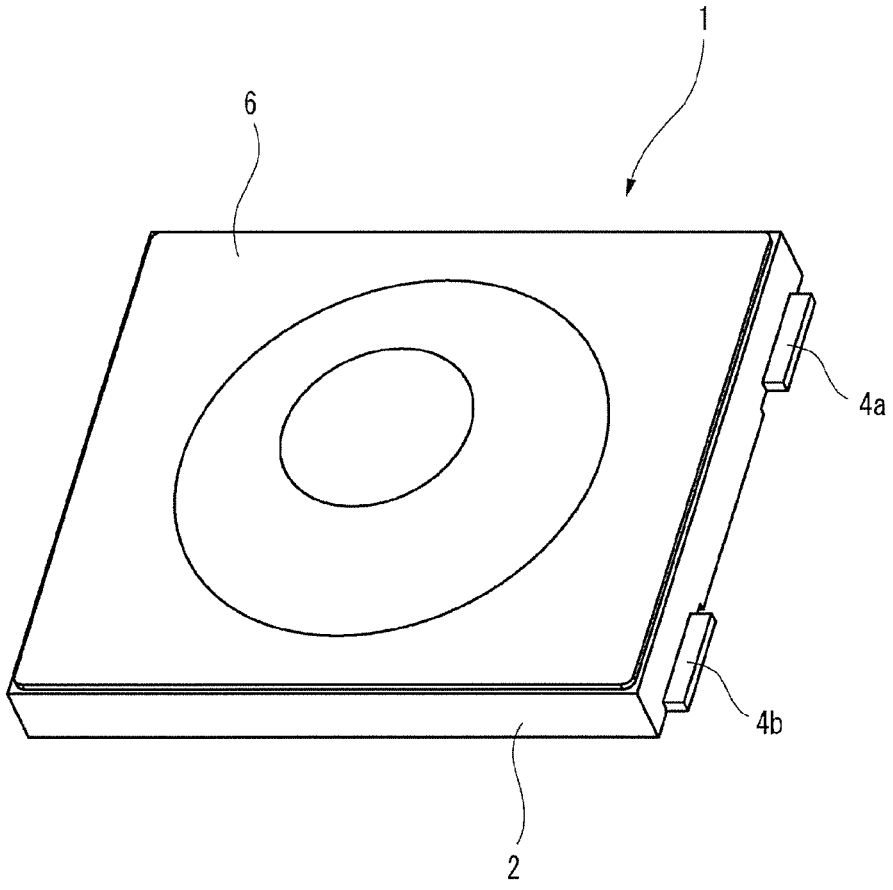
FIG. 1 is an appearance perspective view of a push switch according to a first embodiment of the invention.
Figure 2D:
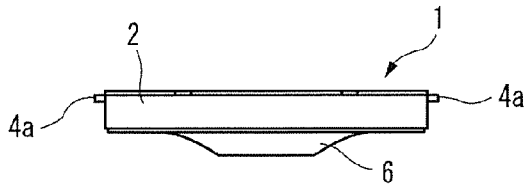
FIGS. 2A to 2E are five-sided views showing appearance of the push switch of FIG. 1.
Figure 2A:
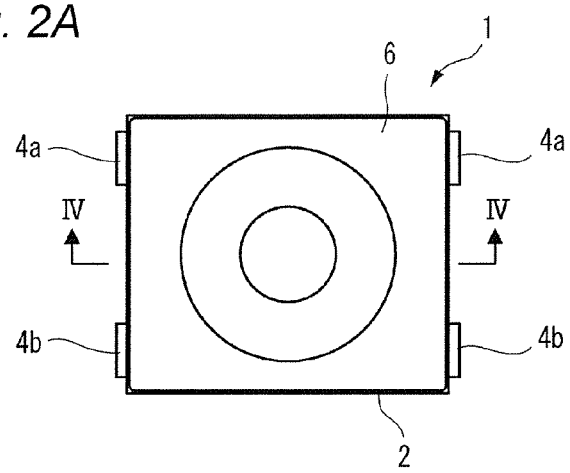
Figure 2E:
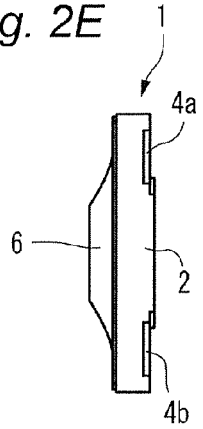
Figure 2B:
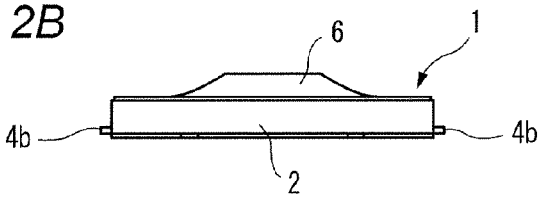
Figure 2C:
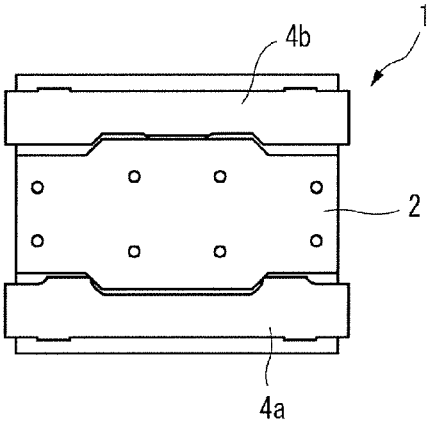

As a first embodiment of a switch according to the invention, a perspective view of a push switch 1 is shown in FIG. 1 and five-sided views are shown in FIGS. 2A to 2E. FIG. 2A is a top view, FIG. 2B is a front view, FIG. 2C is a bottom view, FIG. 2D is a rear view, and FIG. 2E is a right side view. Since a shape viewed from the left side is symmetrical to that shown in the right side view, illustration is omitted.

As shown in these drawings, the push switch 1 has an external appearance in which a pressing member 6 is installed on an upper surface of a case 2 made of an insulating resin mounted on a circuit board.

Figure 3:
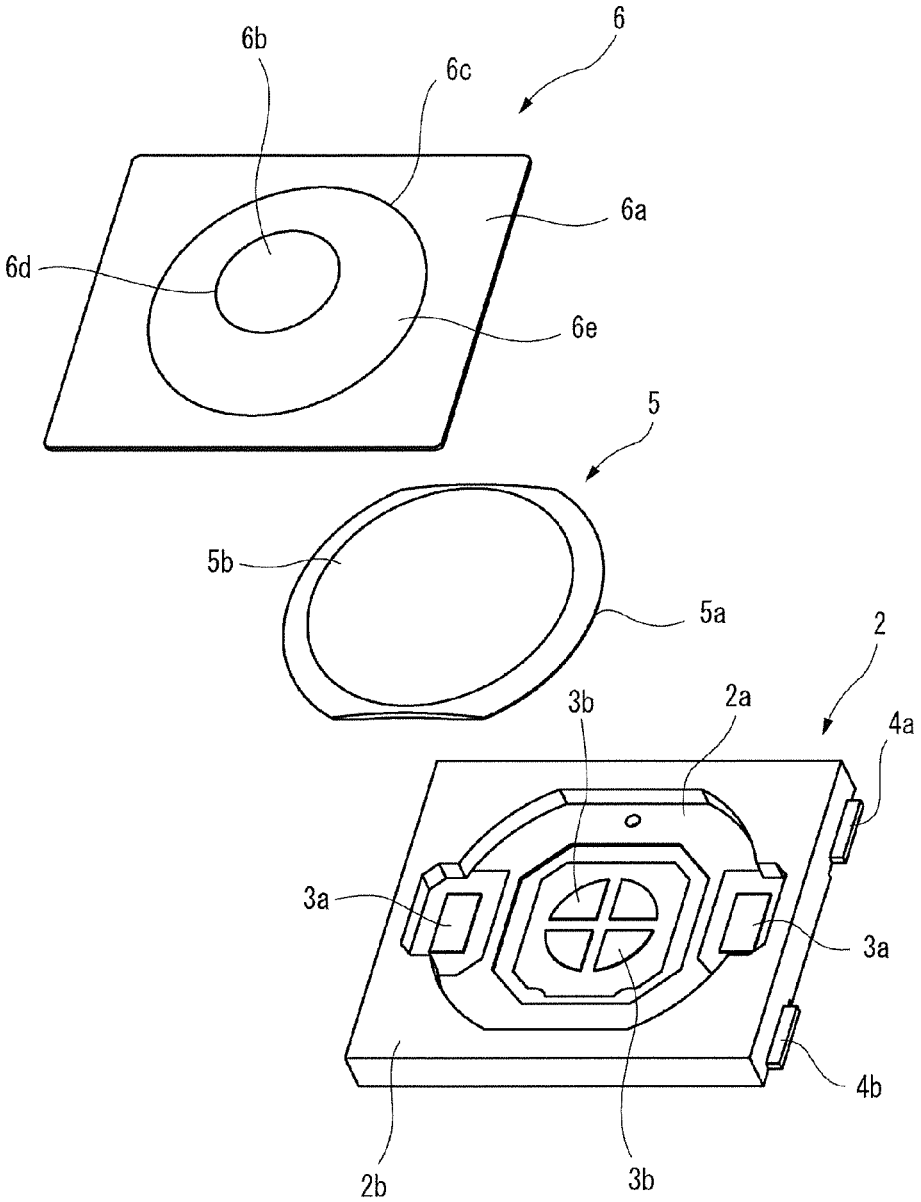
FIG. 3 is an exploded perspective view of the push switch of FIG. 1.

As shown in an exploded perspective view of FIG. 3, the case 2 has an upper surface 2*b* in which a recess 2*a* is opened. Plural first fixed electrodes 3*a* are arranged in the bottom of the recess 2*a*, and plural second fixed electrodes 3*b* are arranged in the center of the bottom. The first fixed electrodes 3*a* and the second fixed electrodes 3*b* function as plural fixed electrodes in the invention.

Each of the first fixed electrodes 3*a* conducts to a first external connecting terminal 4*a* inside the case 2. Each of the second fixed electrodes 3*b* conducts to a second external connecting terminal 4*b* inside the case 2. The first external connecting terminal 4*a* and the second external connecting terminal 4*b* are connected to lands of wiring terminals respectively formed on a mounting surface of the circuit board by soldering.

A movable electrode 5 is stored inside the recess 2*a* of the case 2. The movable electrode 5 is a dome-shaped conductive member capable of elastic deformation. As shown by a section in FIG. 4A, the movable electrode 5 is arranged inside the recess 2*a* so that an outer edge part 5*a* makes contact with the first fixed electrodes 3*a* and a central part 5*b* is opposed to the second fixed electrodes 3*b* through a gap. That is, the movable electrode 5 is in an upwardly convex state at the normal time.

The pressing member 6 is arranged on the upper surface 2*b* (see FIG. 3) of the case 2 so as to cover the recess 2*a*, and is pressed from the upper side (the outside) by operation of a button (not shown) etc.

Figure 4A:
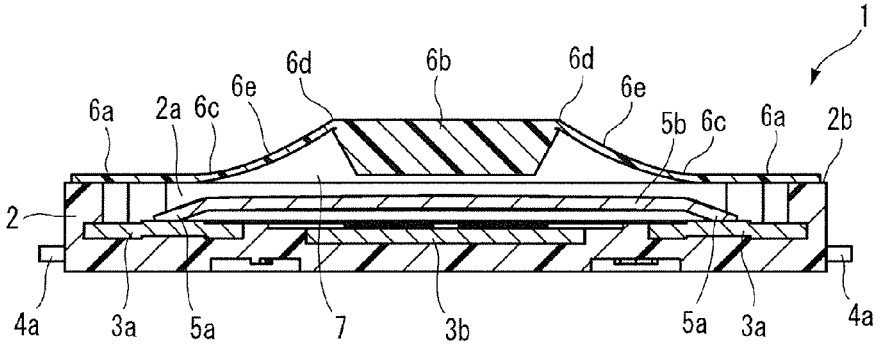
FIGS. 4A and 4B are diagrams showing a section along line IV-IV in FIG. 2A and also describing deformation of each part in the case of applying a pressing force from the outside.
Figure 4B:
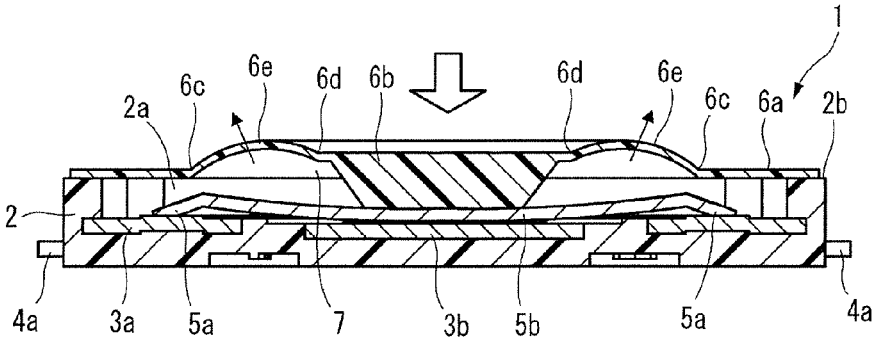

The central part 5*b* of the movable electrode 5 positioned downwardly is pressed through the pressing member 6 by a pressing force associated with the operation of the button (not shown) etc. When a load applied to the movable electrode 5 exceeds a predetermined value, the central part 5*b* is reversed with a click feeling to change to a downwardly convex state and also makes contact with the second fixed electrodes 3*b* as shown in FIG. 4B.

The first fixed electrodes 3*a* and the second fixed electrodes 3*b* are changed to a conductive state through the movable electrode 5 with the reverse of the central part 5*b*. When the pressing force is released, the central part 5*b* returns to the original state (the upwardly convex state) with a click feeling by a self restoring force (elasticity) of the movable electrode 5, and conduction of the first fixed electrodes 3*a* and the second fixed electrodes 3*b* is released. Consequently, at least one first fixed electrode 3*a* and at least one second fixed electrode 3*b* have only to be formed, respectively.

That is, the movable electrode 5 can be displaced between a first position in which the plural mutual fixed electrodes 3*a*, 3*b* are in the conductive state and a second position in which the plural mutual fixed electrodes 3*a*, 3*b* are in a non-conductive state, and the pressing member 6 displaces the movable electrode 5 from the second position to the first position by a pressing force from the outside.

The pressing member 6 is made of materials containing a thermosetting resin or a thermoplastic resin such as a fluorine resin, a PEEK (polyether ether ketone) resin or polyimide. Since these materials have heat resistance, the materials are useful in the case of using reflow processing in soldering at the time of mounting the push switch 1 on the circuit board.

A peripheral edge part 6*a* of the pressing member 6 is glued or welded to the upper surface 2*b* of the case 2. Accordingly, the pressing member 6 demarcates operation space 7 of the movable electrode 5 together with the recess 2*a* of the case 2.

The pressing member 6 includes a press part 6*b* in the center. The press part 6*b* is arranged inside the operation space 7 and is opposed to the central part 5*b* of the movable electrode 5. The press part 6*b* takes on a circular truncated cone shape in which a diameter becomes smaller as the press part is nearer to the movable electrode 5.

The pressing member 6 further includes a first bent part 6*c* and a second bent part 6*d*. As shown in FIG. 3, the second bent part 6*d* extends so as to concentrically surround the press part 6*b*. The first bent part 6*c* extends so as to concentrically surround the press part 6*b* and the second bent part 6*d*.

The portion located in the radial outside of the first bent part 6*c* including the peripheral edge part 6*a* is formed as a flat portion extending in parallel with the upper surface 2*b* of the case 2. The pressing member 6 is inclined upwardly using the first bent part 6*c* as a boundary. As shown in FIGS. 4A and 4B, the first bent part 6*c* is arranged in a position opposed to the recess 2*a* of the case 2. A surface located in the radial inside of the second bent part 6*d* including an upper surface of the press part 6*b* is formed as a flat surface extending in parallel with the upper surface 2*b* of the case 2 using the second bent part 6*d* as a boundary.

A part of the pressing member 6 sandwiched between the first bent part 6*c* and the second bent part 6*d* is called an inclined part 6*e* (a deforming part of the pressing member). In a no-load state (state in which an external force does not act on the pressing member 6) shown in FIG. 4A, the movable electrode 5 is in the second position as described above. At this time, the inclined part 6*e* of the pressing member 6 is opposed to the movable electrode 5 with a gap and is curved toward the recess 2*a* of the case 2.

The inclined part 6*e* is formed thinner than the other region by drawing processing described below performed in the case of forming the pressing member 6. As a result, when a certain external force does not act on the inclined part 6*e*, the inclined part 6*e* can be flexibly deformed independently of the other region of the pressing member 6.

When the pressing member 6 is pressed downwardly with operation of a button (not shown) etc., the press part 6*b* makes contact with the central part 5*b* of the movable electrode 5 and displaces the movable electrode 5 in the first position described above as shown in FIG. 4B. At this time, air present inside the operation space 7 acts as resistance to operation of the pressing member 6. Particularly when hermeticity of the operation space 7 is high, air resistance becomes too high to ignore.

In the present embodiment, the inclined part 6*e* sandwiched between the first bent part 6*c* and the second bent part 6*d* can be flexibly deformed independently of the peripheral edge part 6*a* and the press part 6*b*. Hence, resistance by air in the operation space 7 acts on the inclined part 6*e* as an external force and thereby, the inclined part 6*e* is deformed toward the outside of the case 2. The inclined part 6*e* may be deformed so as to be curved toward the outside of the case 2. Accordingly, an escape of air in the operation space 7 is obtained and downward displacement of the pressing member 6 is not blocked.

Consequently, even in a configuration in which hermeticity of the operation space 7 must be increased by requests for dustproofness and waterproofness, a desired switch operational feeling can be obtained without reducing operability of the pressing member 6.

Figure 5A:
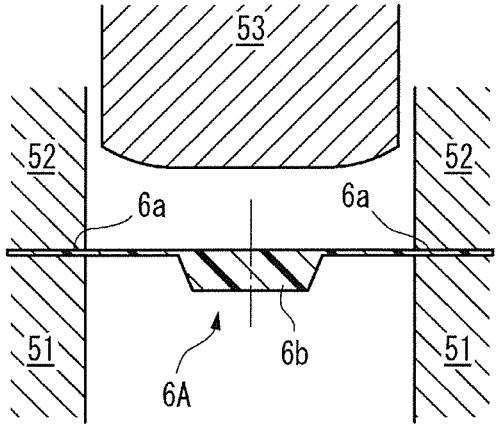
FIGS. 5A to 5C are sectional views describing a manufacturing method of a pressing member of the push switch of FIG. 1.

Next, a manufacturing method of the pressing member 6 will be described with reference to FIGS. 5A to 6B. First, as shown in FIG. 5A, a peripheral edge part 6*a* of a resin molded body 6A molded so as to have a press part 6*b* is pinched by plural dies 51, 52. In the subsequent description, the side in which the press part 6*b* does not project in the resin molded body 6A is called a first side, and the side, opposite to the first side, in which the press part 6*b* projects is called a second side. A punch 53 is arranged in the first side of the resin molded body 6A.

Figure 5B:
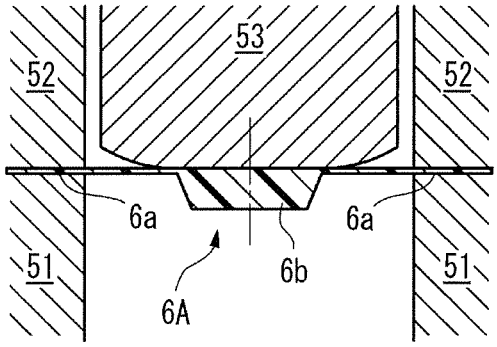
Figure 5C:
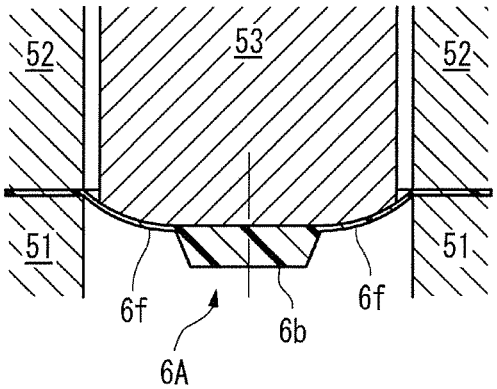

Next, as shown in FIGS. 5B and 5C, drawing processing is performed by pressing from the first side of the resin molded body 6A using the punch 53 and a plastic deformed part 6*f* projecting to the second side is formed. The plastic deformed part 6*f* is formed thinner than the peripheral edge part 6*a* and the press part 6*b*.

Figure 6A:
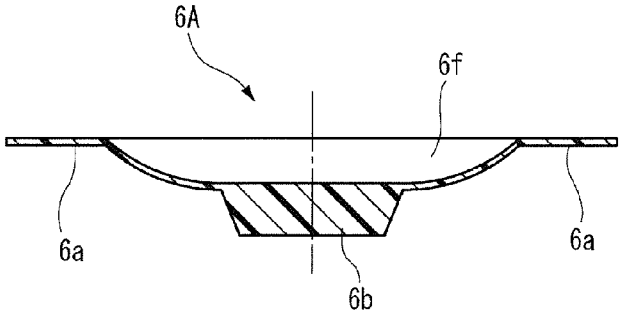
FIGS. 6A and 6B are sectional views describing the manufacturing method of the pressing member of the push switch of FIG. 1.
Figure 6B:
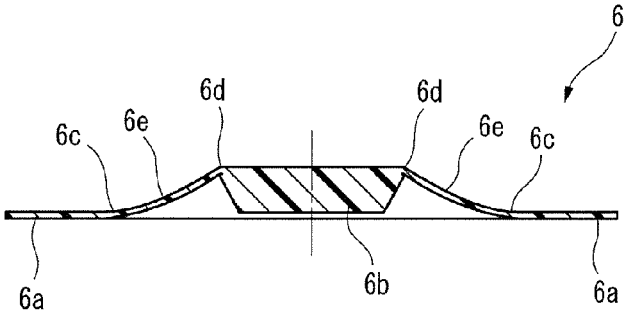

FIG. 6A shows a state in which the resin molded body 6A in which the plastic deformed part 6*f* is formed in this manner is detached from the dies 51, 52. Then, as shown in FIG. 6B, the plastic deformed part 6*f* is deformed so as to project to the first side. This deformation may be produced by upwardly pushing up a lower surface of the press part 6*b*, or by upwardly pulling up an upper surface of the press part 6*b*.

With this deformation, a first bent part 6*c* and a second bent part 6*d* are formed. An inclined part 6*e* curved toward the second side is formed between the first bent part 6*c* and the second bent part 6*d*. That is, the pressing member 6 described above can be obtained.

In addition, the upper surface (first side) of the pressing member 6 has an indentation produced by pressing the punch 53. This indentation can show one of the circumstantial evidences that the above manufacturing method with the drawing processing is implemented.

In addition, it is not always necessary to integrally mold the press part 6*b* as the resin molded body 6A previously. The pressing member 6 may be obtained by performing drawing processing on a film as the resin molded body and forming the plastic deformed part 6*f* and performing deformation so as to project the plastic deformed part 6*f* to the first side and then gluing or welding the press part 6*b* previously molded in a predetermined shape from the second side of the film.

Next, a push switch 1A according to a second embodiment of the invention will hereinafter be described with reference to FIGS. 7A and 7B. The repeated description is omitted by assigning the same reference numerals to substantially the same components as those of the push switch 1 according to the first embodiment.

A configuration of the push switch 1A according to the present embodiment differs that of the push switch 1 according to the first embodiment in that a peripheral edge part 6*a* of a pressing member 6 manufactured by the method described above is directly glued or welded to a circuit board 10. At least one first fixed electrode 3*a* and at least one second fixed electrode 3*b* are respectively arranged on the circuit board 10.

Figure 7A:
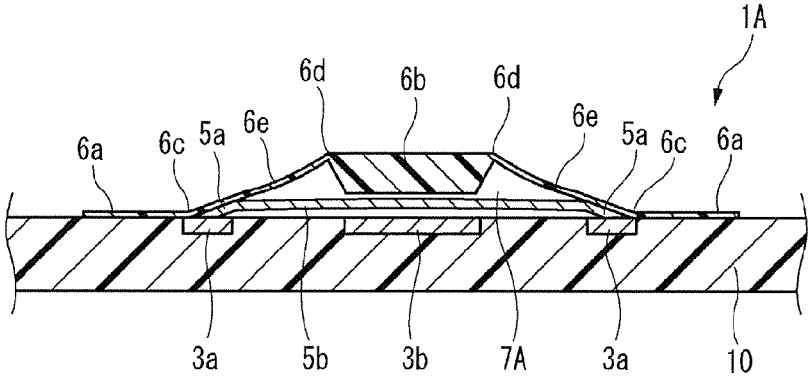
FIGS. 7A and 7B are diagrams describing deformation of each part in the case of applying a pressing force from the outside in a push switch according to a second embodiment of the invention.
Figure 7B:
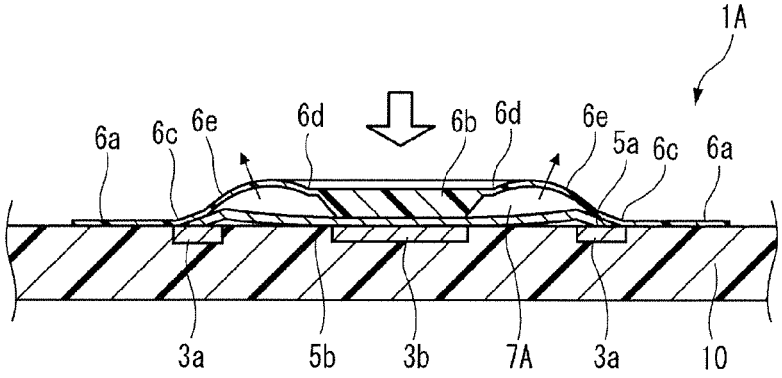

As shown in FIG. 7A, a movable electrode 5 is arranged on the circuit board 10 so that an outer edge part 5*a* makes contact with the first fixed electrodes 3*a* and a central part 5*b* is opposed to the second fixed electrodes 3*b* through a gap. That is, the movable electrode 5 is in an upwardly convex state at the normal time.

The pressing member 6 is arranged on the circuit board 10 so as to cover the first fixed electrodes 3*a*, the second fixed electrodes 3*b* and the movable electrode 5. In the case of being pressed from the upper side (the outside) by operation of a button (not shown) etc., a press part 6*b* depresses the central part 5*b* of the movable electrode 5 and brings the movable electrode 5 into contact with the second fixed electrodes 3*b* as shown in FIG. 7B.

In the present embodiment, operation space 7A of the movable electrode 5 is demarcated by directly gluing or welding the pressing member 6 to the circuit board 10, so that there is a tendency to increase hermeticity. Consequently, when the movable electrode 5 is displaced toward the circuit board 10, air which present inside the operation space 7A acts as resistance to operation of the pressing member 6.

This resistance acts on an inclined part 6*e* and thereby, the inclined part 6*e* is flexibly deformed in a direction away from the circuit board 10. The inclined part 6*e* may be deformed so as to be curved in the direction away from the circuit board 10. Accordingly, an escape of air in the operation space 7A is obtained and downward displacement of the pressing member 6 is not blocked.

Consequently, even in the push switch 1A having a structure with a tendency to increase hermeticity of the operation space 7A, a desired switch operational feeling can be obtained without reducing operability of the pressing member 6.

The embodiments described above are means for facilitating understanding of the invention, and do not limit the invention. The invention can be changed or improved without departing from the gist of the invention and also, the invention naturally includes equivalents of the invention.

In the push switch 1 (1A), it is not always necessary to curve the inclined part 6*e* toward the recess 2*a* (circuit board 10) in a state in which an external force does not act on the pressing member 6. A shape the inclined part 6*e* in an initial state can be freely selected as long as the inclined part 6*e* can be flexibly deformed to the outside of the case 2 (in the direction away from the circuit board 10) when a certain external force acts.

In the push switch 1 (1A), it is not always necessary to curve the inclined part 6*e* toward the outside of the case (the side away from the circuit board 10) when air in the operation space 7 (7A) acts on the inclined part 6*e* as resistance with operation of the pressing member 6. A shape the inclined part 6*e* after deformation can be freely selected as long as the inclined part 6*e* can be flexibly deformed from an initial state to the outside of the case 2 (in the direction away from the circuit board 10).

Representation of the "upper side" and the "lower side" in the description described above is only used for convenience in the description with reference to the drawings, and does not intend to limit directions at the time of using a product. The "upper side" and the "lower side" can be translated into the "direction away from the circuit board" and the "direction near to the circuit board", respectively.

The shape and the number of press parts 6*b* are not limited to the aspects in the embodiments described above, and can properly be determined according to specifications of the push switch 1 (1A).

The shapes of the first bent part 6*c* and the second bent part 6*d* are not limited to the configuration of concentrically surrounding the press part 6*b*, and can properly be determined according to specifications of the push switch 1 (1A) as long as a portion sandwiched between the first bent part 6*c* and the second bent part 6*d* is opposed to the movable electrode 5 with a gap and the portion can be flexibly deformed toward the outside of the case 2 or in the direction away from the circuit board 10 with displacement of the movable electrode 5 in a state in which a pressing force is not applied to the movable electrode 5.

The movable electrode 5 can adopt proper shapes and configurations as long as the movable electrode 5 can be displaced from a position in which the plural mutual fixed electrodes are changed to a non-conductive state to a position in which the plural mutual fixed electrodes are changed to a conductive state by the pressing member 6. It is not always necessary to have elasticity.

According to the present invention, when air in the recess acts as resistance to displacement of the pressing member in the case of displacing the movable electrode from the second position to the first position by a pressing force from the outside, a part of the pressing member is deformed so as to be curved toward the outside of the case. Accordingly, an escape of air is obtained and the displacement of the pressing member is not blocked. Consequently, a desired switch operational feeling can be obtained without reducing operability of the pressing member.

In this case, the amount of deformation of a part of the pressing member can be increased and shock-absorbing properties of air resistance etc. to an external force improve.

According to the present invention, when air in the recess acts as resistance to displacement of the pressing member in the case of displacing the movable electrode from the second position to the first position by a pressing force from the outside, a part of the pressing member is flexibly deformed toward the outside of the case. Accordingly, an escape of air is obtained and the displacement of the pressing member is not blocked. Consequently, a desired switch operational feeling can be obtained without reducing operability of the pressing member.

In this case, the amount of deformation of a part of the pressing member can be increased and shock-absorbing properties of air resistance etc. to an external force improve.

According to the present invention, when air between the pressing member and the circuit board acts as resistance to displacement of the pressing member in the case of displacing the movable electrode from the second position to the first position by a pressing force from the outside, a part of the pressing member is deformed so as to be curved in the direction away from the circuit board. Accordingly, an escape of air is obtained and the displacement of the pressing member is not blocked. Consequently, a desired switch operational feeling can be obtained without reducing operability of the pressing member.

In this case, the amount of deformation of a part of the pressing member can be increased and shock-absorbing properties of air resistance etc. to an external force improve.

According to the present invention, when air between the pressing member and the circuit board acts as resistance to displacement of the pressing member in the case of displacing the movable electrode from the second position to the first position by a pressing force from the outside, a part of the pressing member is flexibly deformed in the direction away from the circuit board. Accordingly, an escape of air is obtained and the displacement of the pressing member is not blocked. Consequently, a desired switch operational feeling can be obtained without reducing operability of the pressing member.

In this case, the amount of deformation of a part of the pressing member can be increased and shock-absorbing properties of air resistance etc. to an external force improve.

By such the manufacturing method according to the present invention, the switch including the pressing member capable of obtaining the effects according to the first to fourth aspects can be obtained.

According to the present invention, a desired switch operational feeling can be obtained even in the case of increasing hermeticity of space for storage of the movable electrode and the fixed electrodes.

What is claimed is:

1. A switch comprising:

a case, configured to be mounted on a circuit board, and including a recess;

a plurality of fixed electrodes arranged inside the recess;

a movable electrode, arranged inside the recess, and configured to be displaced between a first position in which the fixed electrodes are in a conductive state and a second position in which the fixed electrodes are in a non-conductive state; and a pressing member, arranged so as to cover at least a part of the recess, and configured to displace the movable electrode from the second position to the first position by a pressing force from the outside, wherein the pressing member includes a peripheral edge part, a press part, and a deforming part disposed between the peripheral edge part and the press part, wherein said deforming part is thinner than the peripheral edge part and the press part, the deforming part is opposed to the movable electrode with a gap in a state where the movable electrode is in the second position, and the deforming part is configured to be flexibly deformed toward the outside of the case in a state where the movable electrode is in the first position.

2. The switch according to claim 1, wherein the deforming part is configured be curved toward the outside of the case in the state where the movable electrode is in the first position.

3. The switch according to claim 1, wherein the deforming part is configured to be curved toward the recess in the state where the movable electrode is in the second position.

4. A switch comprising:

a circuit board;

a plurality of fixed electrodes arranged on the circuit board;

a movable electrode, configured to be displaced between a first position in which the fixed electrodes are in a conductive state and a second position in which the fixed electrodes are in a non-conductive state; and a pressing member, arranged on the circuit board, covering the fixed electrodes and the movable electrode, and configured to displace the movable electrode from the second position to the first position by a pressing force from the outside, wherein the pressing member includes a peripheral edge part, a press part, and a deforming part disposed between the peripheral edge part and the press part, wherein the deforming part is thinner than the peripheral edge part and the press part, the deforming part is opposed to the movable electrode with a gap in a state where the movable electrode is in the second position, and the deforming part is configured to be flexibly deformed in a direction away from the circuit board in a state where the movable electrode is in the first position.

5. The switch according to claim 4, wherein the deforming part is configured to be curved in the direction away from the circuit board in the state where the movable electrode is in the first position.

6. The switch according to claim 4, wherein the deforming part is configured to be curved toward the circuit board in the state where the movable electrode is in the second position.

7. The switch according to claim 1, wherein the deforming part is a portion made by plastic deformation of a part of the pressing member.

8. The switch according to claim 4, wherein the deforming part is a portion made by plastic deformation of a part of the pressing member.

* * * * *